US005164746A

United States Patent [19]

Nishioka

[11] Patent Number: 5,164,746

[45] Date of Patent: Nov. 17, 1992

[54] ELECTROPHOTOGRAPHIC PRINTER

[75] Inventor: Takafumi Nishioka, Hiroshima, Japan

[73] Assignee: Mitsubishi Denki Kabushiki Kaisha, Hiroshima, Japan

[21] Appl. No.: 523,546

[22] Filed: May 15, 1990

[30] Foreign Application Priority Data

May 16, 1989 [JP] Japan ..... 1-123104

[51] Int. Cl.[5] ..... H04H 1/21

[52] U.S. Cl. ..... 346/108; 355/245

[58] Field of Search ..... 346/107 R, 108, 160; 358/296, 300, 302; 355/245, 326

[56] References Cited

U.S. PATENT DOCUMENTS 4,563,747 1/1986 Tidd ..... 364/523
4,841,329 6/1989 Kasamura et al. ..... 355/245
4,918,466 4/1990 Takahashi ..... 346/108

FOREIGN PATENT DOCUMENTS 61-95956 5/1986 Japan .

*Primary Examiner*—Mark J. Reinhart
*Attorney, Agent, or Firm*—Leydig, Voit & Mayer

[57] ABSTRACT

An electrophotographic printer includes a photosensitive drum which has an outer circumference longer than the whole length of recording paper and which can be rotated selectively forward backword and at a variable speed; an LED head exposes the surface of the photosensitive drum to light so as to form a latent image ccomprising scanning lines a motor control circuit stops the photosensitive drum at a position such that the LED head is opposite a position on the drum corresponding to a scanning line of an input picture a developer can be separated from the surface of the photosensitive drum when the latent image is written and opposes the surface of the photosensitive drum when toner is adhered to the latent image to develop the latent image.

8 Claims, 2 Drawing Sheets

ELECTROPHOTOGRAPHIC PRINTER

BACKGROUND OF THE INVENTION

The present invention relates to an electrophotographic printer using an electrophotographic process.

FIG. 3 is a schematic side view of a main portion of a conventional electrophotographic printer as disclosed, for example, in Japanese Patent Unexamined Publication No. 61-95956, and FIG. 4 is a block diagram of the flow of a picture signal in such an electrophotographic printer.

In the drawings, reference numeral 1 designates a photosensitive drum, and 20 designates an LED head constituted by an LED array 2 and a lens array 3. The LED head 20 is attached to a frame (not shown) in such a manner that the light emitted from the LED array 2 is focused by the lens array 3 on the outer circumference of the photosensitive drum 1 and a group of the focuses forming a scanning line becomes parallel to the axis of the photosensitive drum 1. Thus, the surface of the photosensitive drum 1 is exposed at its position corresponding to the scanning line so that a latent image is written on the surface of the photosensitive drum 1 in accordance with a video signal supplied from a picture processing unit 11 which will be described later. Reference numeral 4 designates a charger for uniformly charging the surface of the photosensitive drum 1, 5 designates a developer for causing toner to adhere to the written latent image, 6 designates a transfer device for transferring the toner developed on the surface of the photosensitive drum 1 to recording paper 7, 8 designates a fixer for heating the transferred toner so as to fix the toner onto the recording paper 7, 9 designates a cleaning device for cleaning the surface of the photosensitive drum 1 after the toner has been transferred; 10 designates a discharger, 11 designates a host computer which is a source for generating a picture signal, and 12 designates a picture processing unit for conversion-processing the picture signal generated by the host computer 11. The picture processing unit 12 converts the picture signal by one page into picture data and stores the picture data in a RAM 13. The picture processing unit 12 takes out the stored data from the RAM converts it into a video signal and supplies the video signal to an LED driver 14. Reference numeral 15 designates a motor for rotating the photosensitive drum 1 at a predetermined speed.

In the thus configured electrophotographic printer, the picture data stored in the RAM 13 is taken out from the RAM 13 in response to a picture print command successively in accordance with the speed of rotation of the photosensitive drum 1, and the LED driver 14 causes the LED array 2 to emit light in form of a scanning line so that the surface of the photosensitive drum 1 is exposed to the light and the latent image is written on the surface of the photosensitive drum 1. The portion where the latent image has been written is rotated by the motor 15 in the direction shown by arrow A, the toner is caused to adhere to the portion of the latent image by the developer 5, and the toner is transferred by the transfer device 6 onto the recording paper 7. Next, the recording paper 7 is heated by the fixer 8 so that the toner is fixed onto the recording paper 7 obtain a completed picture.

In the conventional electrophotographic printer as described above, although, the speed at which the latent image is written by each scanning line is high, the speed of the entire printing process (the speed of rotation of the photosensitive drum 1) is restricted by physical conditions such as developing, transferring, fixing in order to make the quality of the printed picture good. Accordingly, in order to compensate for the speed difference, it has been necessary that the picture data for one page be stored in the RAM 13 and the stored data be consecutively read out.

Accordingly, there has been the problem that the RAM 13 is required. Since RAM 13 requires about 8 megabits per page of an A4 size paper in the case of 300 dpi (dot/inch) resolution, a large number of such memories make the apparatus expensive.

SUMMARY OF THE INVENTION

The present invention has been attained in order to solve the problems described above, and an object thereof is to provide an inexpensive electrophotographic printer using no RAM for temporary storage.

According to the present invention, the electrophotographic printer comprises: a photosensitive drum which has an outer circumference longer than the whole length of recording paper and which can be rotated selectively forward backward and at a variable speed, an LED head for exposing a surface of the photosensitive drum to light so as to write a latent image in every scanning line, means for assigning a rotation stopping position to the photosensitive drum such that the LED is opposite a position on the drum corresponding to a scanning line of an input picture signal, and a developer which is separated from the surface of the photosensitive drum when a latent image is written and which abuts the surface of the photosensitive drum when the toner is adhered to the written latent image to develop.

In the electrophotographic printer according to the present invention, the process of writing the latent image and the process of developing—fixing are separated from each other, the speed and direction of the rotation of the photosensitive drum are changed according to the speed and direction necessary for each process, and the latent image is directly written by the LED head on the surface of the photosensitive drum in accordance with the converted and processed picture signal produced by the host computer.

DETAILED DESCRIPTION OF THE INVENTION

Figure 1:
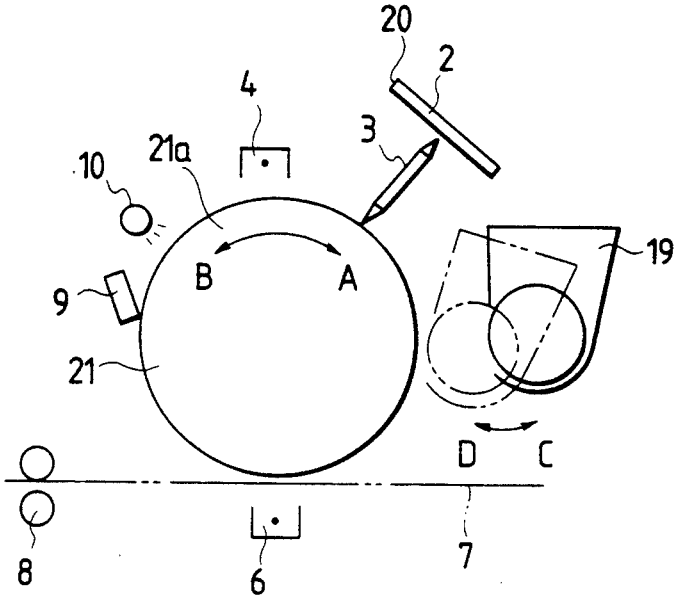
FIG. 1 is a schematic side view of a portion of an embodiment of the electrophotographic printer according to the present invention.
Figure 2:
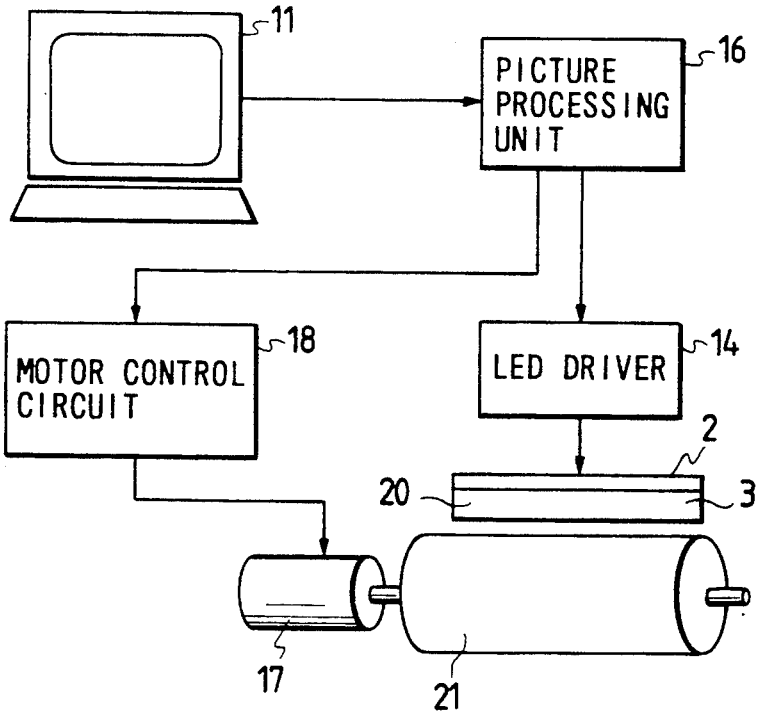
FIG. 2 is a block diagram showing the flow of a picture signal in the embodiment of FIG. 1.

FIG. 1 is a schematic side view of a portion of an embodiment of the electrophotographic printer according to the present invention, and FIG. 2 is a block diagram of the flow of a picture signal in the embodiment of FIG. 1.

Figure 3:
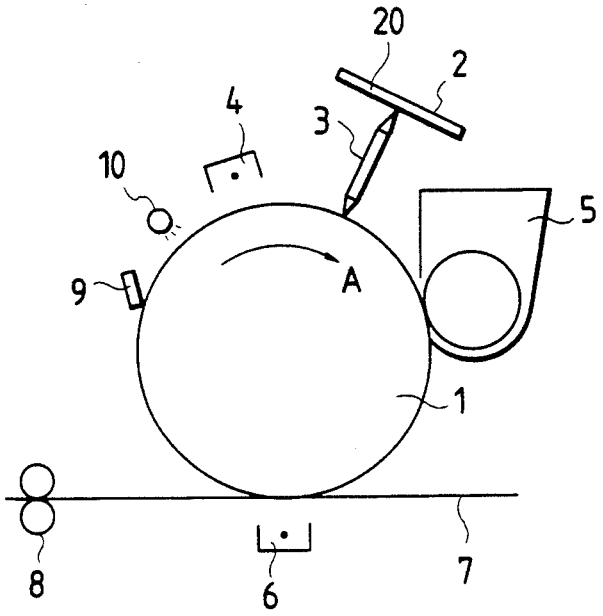
FIG. 3 PRIOR ART
FIG. 3 is a schematic side view of a portion of a conventional electrophotographic printer.
Figure 4:
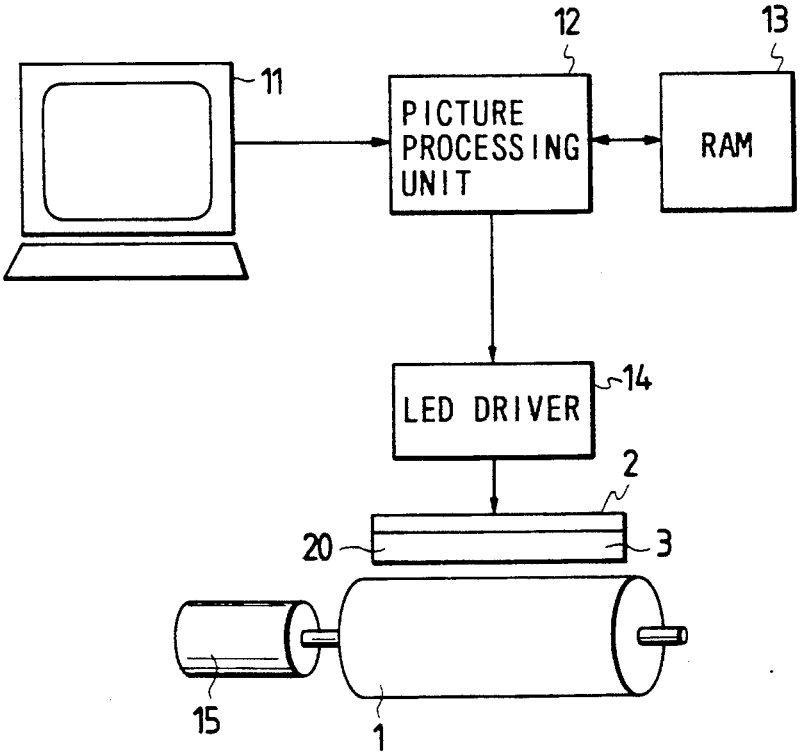
FIG. 4 PRIOR ART
FIG. 4 is a block diagram showing the flow of a picture signal in the conventional printer of FIG. 3.

In the drawings, reference numerals 2–4, 6–11, and 20 designate the same portions as those described with respect to FIGS. 3 and 4. Reference numeral 21 designates a photosensitive drum having an outer circumference longer than the whole length of the recording paper 7 and reference numeral 21*a* designates a reference point on the outer circumference of the photosensitive drum 21. Reference numeral 19 designates a developer having a portion for causing toner to adhere which can be moved into and out of contact with the outer circumferential surface of the photosensitive drum 21. Reference numeral 16 designates a picture processing unit for processing the picture signal supplied from the host computer 11 to convert it into a video signal. The picture processing unit 16 supplies the video signal to an LED driver 14, and supplies positional information on a scanning line corresponding to the video signal to a motor control circuit 18 which will be described later. Reference numeral 17 designates a stepping motor for rotating the photosensitive drum 21. The motor control circuit 18 for controlling the rotation of the stepping motor 17 is arranged to control the direction of rotation, the speed of rotation, and the stopping position of the photosensitive drum 21 in accordance with the positional information on the scanning line supplied from the picture processing unit 16 for the respective processes.

In the electrophotographic printer arranged as described above, at the start of picture printing, in the state where the recording paper 7 is not yet fed, the transfer device 6, the cleaning device 9, and the discharger 10 are stopped operating, the developer 19 is separated from the photosensitive drum 21, and the photosensitive drum 21 is rotated in the direction shown by arrow A so that the whole surface of the photosensitive drum 21 is uniformly charged by means of the charger 4. Then, the charger 4 is stopped The picture processing unit 16 requests that the host computer 11 send the picture signal and receives the picture signal corresponding to the first scanning line. Then, the picture processing unit 16 processes the picture signal to convert it into a video signal, supplies the video signal to the LED driver 14, and supplies scanning line positional information corresponding to the video signal to the motor control circuit 18. The motor control circuit 18 assigns the photosensitive drum 21 a stopping position such that the LED head 20 is opposite from a scanning line position measured from the reference point 21*a*, rotates the stepping motor 17 in the direction shown by arrow B, and stops the motor 17 when the photosensitive drum 21 reaches the assigned stopping position. Then, the LED driver 14 causes the LED array 2 to emit light in accordance with the position-assigning completion signal of the stepping motor 17 so as to expose the surface of the photosensitive drum 21.

Upon receiving an exposure completion signal, the picture processing unit 16 supplies a request to the host computer 11 so that the host computer 11 sends out a picture signal corresponding to the succeeding scanning line, and then exposure corresponding to every scanning line is similarly successively performed to form a latent image on the surface of the photosensitive drum 21. At that time, in the case where the scanning-line positions of the picture signals sent from the host computer 11 are not in order but in reverse order, the stepping motor 17 rotates the photosensitive drum 21 fast or in reverse so as to move the scanning line position on the photosensitive drum 21 to a position opposite the LED head 20. When the exposure of one page has been completed, the recording paper 7 is fed, the developer 19 is caused to oppose the surface of the photosensitive drum 21, the photosensitive drum 21 rotates at a predetermined speed necessary to development and fixing in the direction shown by arrow A, the latent image is developed, and the toner is transferred to the recording paper 7 so as to be fixed, thus completing the picture printing.

After the toner has been transferred, the surface of the photosensitive drum 21 is cleaned by the cleaning device 9 and discharged by the discharger 10 so as to return to the original state for subsequent picture printing.

As described above, according to the present invention, the process of writing the latent image and the process of developing-fixing are separated from each other, the speed of rotation is changed to a required speed for each of the processes, and the latent image is directly written by the LED head on the surface of the photosensitive drum in accordance with the picture signal supplied from the host computer. Accordingly, it is possible to provide an inexpensive electrophotographic printer using no RAM for temporary storage.

What is claimed is:

1. An electrophotographic printer comprising:

a photosensitive drum which has an outer circumference longer than a sheet of recording paper on which an image is to be printed by the printer and which can be rotated selectively forward and backward and at a variable speed;

an LED head for exposing a surface of said photosensitive drum to light so as to form a latent image in the form of scanning lines on said drum;

means for assigning a rotation stopping position to said photosensitive drum such that said LED head is opposite from a position on said photosensitive drum corresponding to a scanning line of an input picture signal; and a developer which is separated from the surface of said photosensitive drum when the latent image is formed and which abuts the surface of said photosensitive drum when a toner is adhered to the latent image to develop the latent image.

2. An electrophotographic printer comprising:

a photosensitive drum having a surface;

a drive motor connected to the drum for rotating the drum;

light source means for exposing the surface of the drum with light to form a latent image on the drum;

a developer movable between a first position in which the developer is separated from the surface of the drum when the latent image is being formed and a second position in which the developer can develop the latent image; and motor control means for controlling the motor to rotate at a first speed when the latent image is being formed and at a second speed different from the first speed when the developer is developing the latent image.

3. A printer as claimed in claim 2 wherein the motor control means comprises means for controlling the motor to rotate at the first speed until a latent image for an entire page has been formed on the drum.

4. A printer as claimed in claim 3 wherein the motor control means comprises means for controlling the motor to rotate at the second speed until a latent image for an entire page has been developed.

5. A printer as claimed in claim 2 wherein the motor control means comprises means for controlling the motor to rotate in a first direction when the latent image is being formed and to rotate in a second direction opposite from the first direction when the latent image is being developed.

6. A printer as claimed in claim 3 wherein the drum has a circumference sufficiently large to hold a latent image for an entire page to be printed with the drum.

7. A printer as claimed in claim 3 wherein the developer contacts the drum when the developer is in its second position.

8. An electrophotographic printer comprising:

a photosensitive drum having a surface;

a drive motor connected to the drum for rotating the drum;

a light source disposed in the vicinity of the drum for exposing the surface of the drum with light to form a latent image on the drum;

a developer disposed in the vicinity of the drum for developing the latent image; and motor control means for controlling the motor to rotate at a first speed when the latent image is being formed and at a second speed different from the first speed when the developer is developing the latent image.

* * * * *